US007708499B1

(12) United States Patent
Evarts et al.

(10) Patent No.: US 7,708,499 B1
(45) Date of Patent: May 4, 2010

(54) CLAMP SYSTEMS AND METHODS FOR PILE DRIVERS AND EXTRACTORS

(75) Inventors: Kingsley S. Evarts, Pittsburg, PA (US); John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 832 days.

(21) Appl. No.: 11/294,141

(22) Filed: Dec. 5, 2005

Related U.S. Application Data

(60) Provisional application No. 60/641,289, filed on Jan. 3, 2005.

(51) Int. Cl.
*E02D 11/00* (2006.01)
*E02D 7/00* (2006.01)
*E21B 7/20* (2006.01)

(52) U.S. Cl. ..... 405/232; 405/245; 175/171; 269/152

(58) Field of Classification Search ..... 405/198, 405/199, 223, 232, 245; 175/171; 269/152
See application file for complete search history.

(56) References Cited

U.S. PATENT DOCUMENTS

| | | | | |
|---|---|---|---|---|
| 1,787,000 | A | | 12/1930 | Hunt |
| 3,300,987 | A | | 6/1964 | Maeda |
| 3,149,851 | A | | 9/1964 | Adams |
| 3,243,190 | A | | 3/1966 | Peregrine |
| 3,391,435 | A | | 7/1968 | Lebelle |
| 3,530,947 | A | | 9/1970 | Gendron |
| 3,620,137 | A | * | 11/1971 | Prasse ..... 92/159 |
| 3,686,877 | A | | 8/1972 | Bodin |
| 3,720,435 | A | | 3/1973 | Leyn |
| 3,828,864 | A | | 8/1974 | Haverkamp et al. |
| 3,959,557 | A | * | 5/1976 | Berry ..... 428/368 |
| 3,998,063 | A | | 12/1976 | Harders |
| 4,099,387 | A | | 7/1978 | Frederick et al. |

(Continued)

FOREIGN PATENT DOCUMENTS

DE 40 10357 A1 10/1990

OTHER PUBLICATIONS www.mmsonline.com/columns/micro-keying-keeps-a-better-grip.aspx, Seibert, Stan, Modern Machine Shop: "Micro-Keying Keeps A Better Grip", Aug. 1, 1999.*

(Continued)

*Primary Examiner*—Tara Mayo-Pinnock
(74) *Attorney, Agent, or Firm*—Michael R. Schacht; Schacht Law Office, Inc.

(57) ABSTRACT

A clamp assembly for securing a vibratory device to a pile comprising a frame, first and second clamp members, and an actuator. The frame is adapted to be secured to the vibratory device. The first clamp member is supported by the frame and comprises a first engaging surface defined by a first surface layer formed of carbide alloy material. The second clamp member is also supported by the frame and comprises a second engaging surface defined by a second surface layer formed of carbide alloy material. The actuator is arranged to displace at least one of the first and second clamp members such that first and second engaging surfaces engage the pile such that the pile is gripped by between first and second clamp members.

14 Claims, 2 Drawing Sheets

U.S. PATENT DOCUMENTS

| | | | | |
|---|---|---|---|---|
| 4,758,148 | A * | 7/1988 | Jidell | 425/219 |
| 5,355,964 | A | 10/1994 | White | |
| 5,375,897 | A | 12/1994 | Gazel-Anthoine | |
| 5,544,979 | A | 8/1996 | White | |
| 5,549,168 | A | 8/1996 | Sadler et al. | |
| 5,609,380 | A | 3/1997 | White | |
| 5,653,556 | A | 8/1997 | White | |
| 5,794,716 | A | 8/1998 | White | |
| 6,386,295 | B1 | 5/2002 | Suver | |
| 6,447,036 | B1 | 9/2002 | White | |
| 6,582,158 | B1 | 6/2003 | Van Stein | |
| 6,648,556 | B1 * | 11/2003 | White | 405/249 |
| 6,672,805 | B1 | 1/2004 | White | |
| 6,896,448 | B1 | 5/2005 | White | |
| 6,908,262 | B1 | 6/2005 | White | |

OTHER PUBLICATIONS

International Construction Equipment, Inc. (ICE), "Hydraulic Vibratory Driver/Extractors for Piling and Caisson Work", reference No. V7-0890-51 updated, 3 pages.

International Construction Equipment, Inc. (ICE), "Hydraulic Vibratory Driver/Extractors for Piling and Caisson Work", undated, 3 pages.

* cited by examiner

CLAMP SYSTEMS AND METHODS FOR PILE DRIVERS AND EXTRACTORS

RELATED APPLICATIONS

This application claims benefit of U.S. Provisional Application Ser. No. 60/641,289 filed on Jan. 3, 2005.

The contents of all related applications listed above are incorporated herein by reference.

TECHNICAL FIELD

The present invention relates to methods and apparatus for inserting rigid members into or extracting rigid members from the earth and, more particularly, to clamp systems and methods that attach a pile driver/extractor to a pile to be driven and/or extracted.

BACKGROUND OF THE INVENTION

For certain construction projects, rigid members, such as piles, anchor members, caissons, sheet pile barriers, and mandrels for inserting wick drain material, must be placed into the earth. The term "piles" will be used herein to refer to the rigid members typically driven into the earth during construction projects. It is well-known that such rigid members may often be driven into or extracted from the earth without excavation by applying a driving or extracting force on an upper end of the pile.

When applying a downward driving force to a pile, it is not necessary, although perhaps desirable, to clamp the pile driver to the pile. However, when a pile is extracted from the earth, a clamp system must be used to transmit an upward extracting force to the pile to pull the pile from the earth. In addition, during both pile driving and pile extracting, a reciprocating vibratory force, typically up and down, may be applied in addition to the driving or pulling force. The use of vibratory forces also requires a clamp system to ensure that the vibratory forces are effectively transmitted to the pile.

A clamp system typically comprises first and second clamp members that engage the pile. A clamping force may be applied to one or both of the clamp members such that the pile or a portion of the pile is securely gripped between the clamp members. The clamp members may be contoured to accommodate the shape of the pile or portion of the pile to be gripped. The clamp members may be otherwise textured in some form to increase friction between the clamp members and the pile.

A primary point of failure of a pile driving or extracting system is when the driving, pulling, and/or vibratory forces are not adequately transmitted to the pile. The need thus exists for improved clamp systems for pile extractors and for pile drivers and extractors that employ vibratory forces.

SUMMARY OF THE INVENTION

A clamp assembly for securing a vibratory device to a pile comprising a frame, first and second clamp members, and an actuator. The frame is adapted to be secured to the vibratory device. The first clamp member is supported by the frame and comprises a first engaging surface defined by a first surface layer formed of carbide alloy material. The second clamp member is also supported by the frame and comprises a second engaging surface defined by a second surface layer formed of carbide alloy material. The actuator is arranged to displace at least one of the first and second clamp members such that first and second engaging surfaces engage the pile such that the pile is gripped by between first and second clamp members.

DETAILED DESCRIPTION OF THE INVENTION

Figure 1:
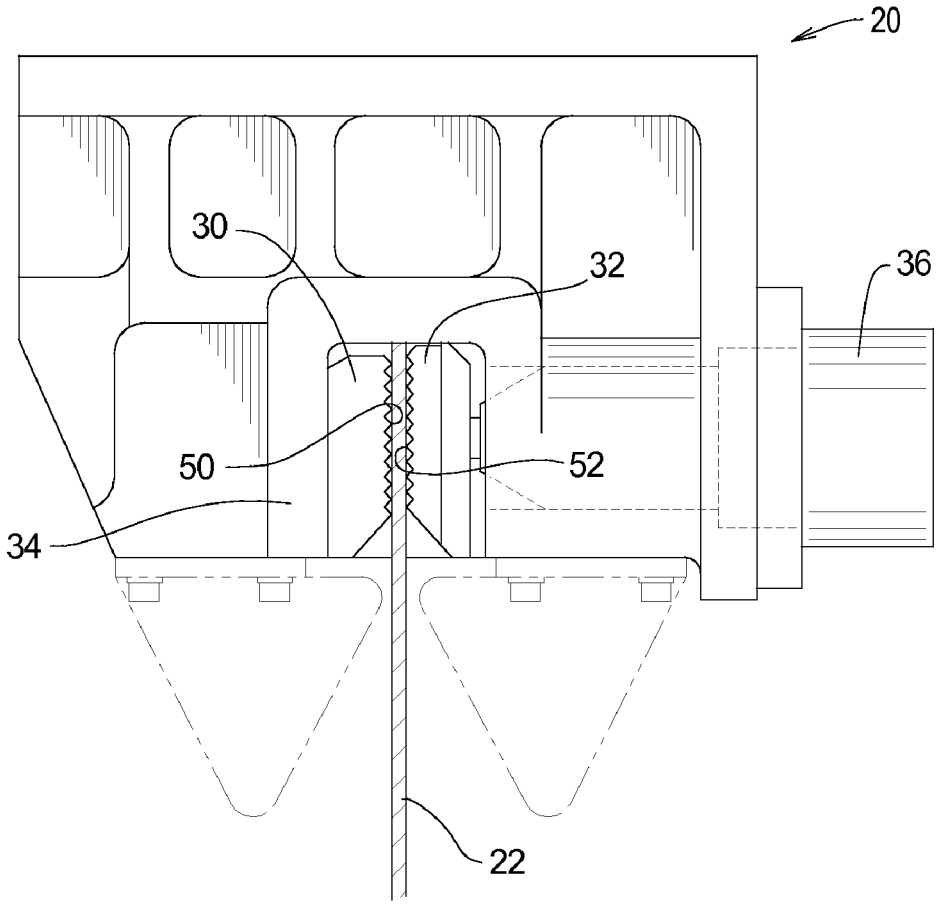
FIG. 1 is a side elevation view of one example embodiment of a clamp system of the present invention.

Referring to FIG. 1 of the drawing, depicted at 20 therein is a clamp assembly constructed in accordance with, and embodying, the principles of the present invention. The clamp assembly 20 is adapted to be connected to a vibratory device (not shown) and engages a pile 22 such that vibratory forces generated by the vibratory device are transmitted to the pile 22. The present invention is of particular significance in the context of a clamp assembly for sheet piles such as the clamp assembly 20 depicted and described herein, but a clamp assembly constructed in accordance with the present invention can be adapted to engage piles of different shapes and materials as will generally be described below.

Figure 2:
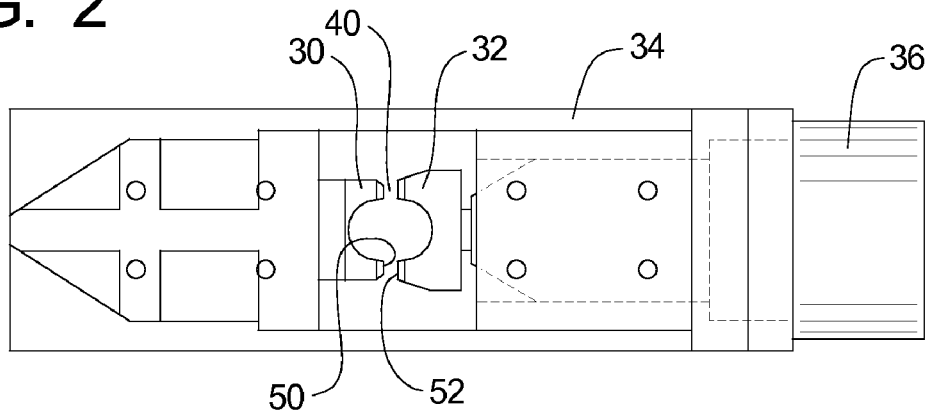
FIG. 2 is a bottom plan view of the clamp system of FIG. 1.

The clamp assembly 20 comprises first and second clamp members 30 and 32. The first clamp member 30 is fixed relative to a clamp frame 34. The second clamp member 32 is mounted on an actuator 36 supported by the clamp frame 34. The actuator 36, which is operated by a hydraulic system (not shown), displaces the second clamp member 32 relative to the clamp frame 34 and thus relative to the first clamp member 30. The first clamp member 30 and the actuator 36 are supported by the clamp frame 34 such that the actuator 36 moves the second clamp member 32 towards and away from the first clamp member 30. When the clamp assembly 20 is arranged such that the pile 22 is in a clamp space 40 (FIG. 2) between the first and second clamp members 30 and 32, operation of the actuator 36 causes the pile 22 to be clamped between the clamp members 30 and 32 as shown in FIG. 1.

Figure 4:
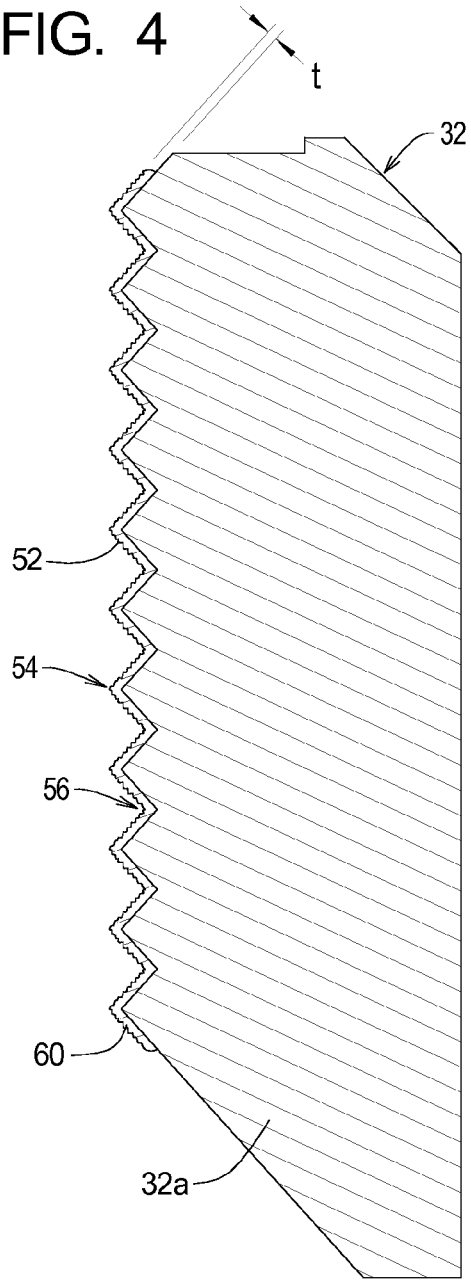

The first and second clamp members 30 and 32 define first and second engaging surfaces 50 and 52, respectively. The example second clamp member 32 is depicted in further detail in FIG. 4 of the drawing. FIG. 4 illustrates that the second engaging surface 52 defines peaks 54 and valleys 56 and is defined by a surface layer 60. The first engaging surface 50 may optionally be defined by a similar surface layer formed on the first clamp member 30.

Figure 3:
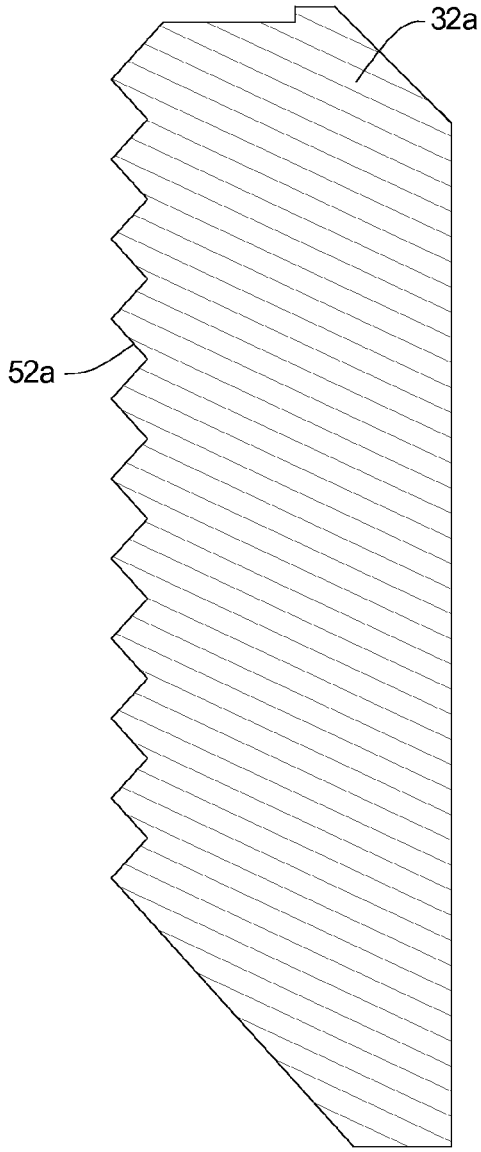
FIGS. 3 and 4 are side, elevation sectional views of a clamp member of the present invention before and after, respectively, application of a surface layer.

To fabricate the example second clamp member 32, FIG. 3 illustrates that the second clamp member 32 is originally constructed in a generally conventional manner in a pre-coated form 32*a*. In the pre-coated form 32*a*, the second clamp member 32 defines an uncoated surface 52*a*. The surface layer 60 is deposited or otherwise formed on the uncoated surface 52*a* to create the second engaging surface 52 of the second clamp member 32.

The surface layer 60 is formed using a carbide alloy coating that is sprayed or otherwise deposited on the uncoated surface 52*a*. One example process for forming the surface layer 60 is marketed under the brand name CARBINITE Metal Coatings. Other processes for applying metal coatings similar to the CARBINITE process may be used instead or in addition.

The surface layer 60 defines a "build-up" dimension generally corresponding to the thickness "t" of the layer 60 and also a texture or "grit" that generally defines the friction of the second engaging surface 52. The thickness "t" of the surface layer 60 is typically within a first preferred range of 0.006" and 0.017", may be within a second preferred range of 0.0025" and 0.017", and in any event is within a third preferred range of at least 0.0025". The grit of the surface layer is typically within a first range of substantially between 100 Emery and 36 Emery, may be within a second preferred range of substantially between 180 Emery and 36 Emery, and in any event should be within a third preferred range of at least 180 Emery.

The exact thickness "t" and grit of the surface layer 60 should be determined based on the character of the pile being driven. With the example metal sheet pile 22, the grit is preferably within approximately 180 Emery and 100 Emery. For a clamp assembly that will be used to extract a wooden pile that is coated with slime, barnacles, and/or the like, the grit is preferably greater than 60 Emery to enhance friction. For a plastic sheet pile, the grit is preferably in the range of approximately smooth to 180 Emery to reduce damage to the plastic material from which the pile is made.

The thickness "t" can also be increased to increase the wear resistance of the second engaging surface 52. For example, the pre-coated form 32*a* of the second clamp member 32 may be made of relatively soft material that is inexpensive and easy to machine. The surface layer 60 may be applied by building up the thickness "t" thereof using several applications of the coating material to increase the thickness of the surface layer 60 on the pre-coated second clamp member 32*a* and thus protect the engaging surface 52.

From the foregoing, it should be clear that the present invention may be embodied in forms other than the form described above. The above-described embodiment is therefore to be considered in all respects illustrative and not restrictive.

What is claimed is:

1. A clamp assembly for securing a vibratory device to a pile comprising:

a frame adapted to be secured to the vibratory device;

a first clamp member supported by the frame, the first clamp member comprising a first engaging surface defining peaks and valleys and comprising a first surface layer of carbide alloy material formed on the peaks and valleys defined by the first engaging surface;

a second clamp member supported by the frame, the second clamp member comprising a second engaging surface defining peaks and valleys and comprising a second surface layer of carbide alloy material formed on the peaks and valleys defined by the second engaging surface; and an actuator arranged to displace at least one of the first and second clamp members such that the first and second engaging surfaces engage the pile such that the pile is gripped between the first and second clamp members; where the first and second engaging surface layers define a grit of at least 180 Emery to enhance friction between the first and second clamp members and the pile when the pile is gripped between the first and second clamp members; and the first and second engaging surface layers define a thickness of at least 0.0025 inches.

2. A clamp assembly as recited in claim 1, in which the first and second surface layers define a thickness dimension of substantially between approximately 0.0025 inches and approximately 0.017 inches.

3. A clamp assembly as recited in claim 1, in which the first and second surface layers define a thickness dimension of substantially between approximately 0.006 inches and approximately 0.017 inches.

4. A clamp assembly as recited in claim 1, in which at least one of the first and second surface layers defines a grit of substantially between approximately 180 Emery and approximately 36 Emery.

5. A clamp assembly as recited in claim 1, in which at least one of the first and second surface layers defines a grit of substantially between approximately 100 Emery and approximately 36 Emery.

6. A clamp assembly as recited in claim 1, in which the first and second surface layers define a grit of substantially between approximately 180 Emery and approximately 36 Emery.

7. A clamp assembly as recited in claim 1, in which the first and second surface layers define a grit of substantially between approximately 100 Emery and approximately 36 Emery.

8. A clamp assembly as recited in claim 1, in which the first and second surface layers are formed by the application of coating material.

9. A clamp assembly as recited in claim 8, in which the first and second surface layers are formed by a plurality of applications of coating material.

10. A method of securing a vibratory device to a pile comprising the steps of:

securing a frame to the vibratory device;

providing a first clamp member comprising a first engaging surface defining peaks and valleys;

forming a first surface layer of carbide alloy material on the peaks and valleys of the first clamp member such that the first surface layer defines the first engaging surface and the first engaging surface has a grit of at least 180 Emery, where the first surface layer has a thickness of at least 0.0025 inches;

providing a second clamp member comprising a second engaging surface defining peaks and valleys;

forming a second surface layer of carbide alloy material on the peaks and valleys of the second clamp member such that the second surface layer defines the second engaging surface and the second engaging surface has a grit of at least 180 Emery, where the second surface layer has a thickness of at least 0.0025 inches;

supporting the first and second clamp members on the frame; and displacing at least one of the first and second clamp members such that first and second engaging surfaces engage the pile such that the pile is gripped between the first and second clamp members.

11. A method as recited in claim 10, in which the step of forming at least one of the first and second surface layers comprises the step of applying coating material to one of the first and second clamp members.

12. A method as recited in claim 11, in which the step of forming at least one of the first and second surface layers comprises the step of applying coating material to one of the first and second clamp members in a plurality of applications.

13. A method as recited in claim 10, in which the step of forming the first and second surface layers comprises the step of applying coating material to the first and second clamp members.

14. A method as recited in claim 13, in which the step of forming the first and second surface layers comprises the step of applying coating material to the first and second clamp members in a plurality of applications.

* * * * *